US009183772B2

(12) United States Patent
Tsuchi

(10) Patent No.: US 9,183,772 B2
(45) Date of Patent: Nov. 10, 2015

(54) DATA DRIVER FOR PANEL DISPLAY APPARATUSES

(75) Inventor: Hiroshi Tsuchi, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 394 days.

(21) Appl. No.: 13/477,377

(22) Filed: May 22, 2012

(65) Prior Publication Data

US 2012/0306826 A1 Dec. 6, 2012

(30) Foreign Application Priority Data

Jun. 3, 2011 (JP) ..... 2011-125519

(51) Int. Cl.

| | |
|---|---|
| ***G09G 3/32*** | (2006.01) |
| ***G09G 3/00*** | (2006.01) |
| ***G09G 3/36*** | (2006.01) |

(52) U.S. Cl.

CPC ..... *G09G 3/006* (2013.01); *G09G 3/3291* (2013.01); *G09G 3/3688* (2013.01); *G09G 2300/043* (2013.01); *G09G 2310/0291* (2013.01)

(58) Field of Classification Search

CPC ... G09G 3/006; G09G 3/3291; G09G 3/3688; G09G 2310/0291; G09G 2310/043

USPC ..... 345/204, 98, 214, 77, 87; 349/149

See application file for complete search history.

(56) References Cited

U.S. PATENT DOCUMENTS

| | | | | |
|---|---|---|---|---|
| 7,466,387 | B2 | 12/2008 | Kim et al. | |
| 2004/0135956 | A1 | 7/2004 | Kim et al. | |
| 2006/0244710 | A1 * | 11/2006 | Iriguchi et al. | 345/100 |
| 2011/0001749 | A1 * | 1/2011 | Min et al. | 345/214 |
| 2012/0306502 | A1 * | 12/2012 | Somayajula et al. | 324/414 |

FOREIGN PATENT DOCUMENTS

| | | | |
|---|---|---|---|
| JP | 07-134305 | A | 5/1995 |
| JP | 10-153791 | A | 6/1998 |
| JP | 2004-70317 | A | 3/2004 |
| JP | 2009-008948 | A | 1/2009 |
| JP | 2010-107655 | A | 5/2010 |

OTHER PUBLICATIONS

Communication dated Oct. 28, 2014 from the Japanese Patent Office in counterpart application No. 2011-125519.

* cited by examiner

*Primary Examiner* — Premal Patel
(74) *Attorney, Agent, or Firm* — Sughrue Mion, PLLC

(57) ABSTRACT

A data driver for display panels includes: multiple driver output terminals coupled to multiple data lines of a display panel; and multiple output circuits that output output signals from the driver output terminals. Each output circuit includes: an output buffer that outputs an output signal; a first resistor having one end coupled to one of the driver output terminals; a first switch and a second resistor coupled in series between an output node of the output buffer and the other end of the first resistor; and a second switch coupled in parallel to the first switch and the second resistor between the output node of the output buffer and the other end of the first resistor.

9 Claims, 6 Drawing Sheets r11=r21=r31=r41

DATA DRIVER FOR PANEL DISPLAY APPARATUSES

CROSS-REFERENCE TO RELATED APPLICATIONS

The disclosure of Japanese Patent Application No. 2011-125519 filed on Jun. 3, 2011 including the specification, drawings and abstract is incorporated herein by reference in its entirety.

BACKGROUND

The present invention relates to a data driver for panel display apparatuses and in particular to a driver configured to drive the data lines of flat panel display apparatuses (LCDs, OLED displays).

Many types of flat panel display apparatuses, including liquid crystal display apparatuses and organic light-emitting diode display apparatuses, have been commercialized in recent years. One of the methods for driving such display apparatuses is active matrix. Referring to FIGS. 3A to 3C, a typical configuration of an active-matrix flat panel display apparatus (liquid crystal display apparatus or organic light-emitting diode display apparatus) will be outlined. FIG. 3A is a block diagram showing the main part configuration of a flat display apparatus; FIG. 3B shows the main part configuration of a unit pixel of the display panel of a liquid crystal display apparatus; and FIG. 3C shows the main part configuration of a unit pixel of the display panel of an organic light-emitting diode display apparatus. The unit pixels of FIGS. 3B and 3C are represented by schematic equivalent circuits.

Referring to FIG. 3A, a typical active-matrix flat panel display apparatus includes a power supply circuit 940, a display controller 950, a display panel 960, a gate driver 970, and a data driver 980. In the display panel 960, unit pixels each including a pixel switch 964 and a display element 963 are arranged in a matrix. (In a color SXGA (super extended graphics array) panel, for example, 1280×3 pixel columns×1024 pixel rows are arranged.) Scan lines 961 for transmitting scan signals outputted from the gate driver 970 and data lines 962 for transmitting gray-scale voltage signals outputted from output buffers (not shown) of the data driver 980 are arranged in a grid. The gate driver 970 and the data driver 980 are controlled by the display controller 950. Clocks CLK, control signals, and the like required for these drivers are provided thereto by the display controller 950. Image data is provided to the data driver 980 in the form of digital signals. The power supply circuit 940 supplies required power to the gate driver 970 and the data driver 980. The display panel 960 includes a semiconductor substrate. In particular, most of large-screen display apparatuses use a semiconductor substrate obtained by forming pixel switches using thin-film transistors (TFTs) on an insulating substrate such as a glass substrate or plastic substrate.

The above-mentioned display apparatus displays an image by on-off controlling the pixel switches 964 using scan signals, applying gray-scale voltage signals corresponding to pieces of image data to the display elements 963 when the pixel switches 964 are turned on, and changing the luminance of the display elements 963 in accordance with the gray-scale voltage signals.

Data corresponding to one screen is rewritten in one frame period (usually, about 0.017 sec at a 60-Hz drive frequency). Specifically, pixel rows (lines) corresponding to the scan lines 961 are sequentially selected, that is, the pixel switches 964 are turned on. Gray-scale voltage signals are provided from the data lines 962 to the display elements 963 via the pixel switches 964 in a selection period. In some cases, multiple pixel rows are simultaneously selected by a single scan line or the display apparatus is driven at a frame frequency of 60 Hz or more.

Referring to FIGS. 3A and 3B, the display panel 960 of the liquid crystal display apparatus includes a semiconductor substrate, a counter substrate, and liquid crystal sealed between the opposite two substrates. The semiconductor substrate has unit pixels each including a pixel switch 964 and a display element 963 arranged in a matrix thereon. The counter substrate has a single transparent electrode 974 formed on an entire surface thereof. A display element 963 included in a unit pixel includes a pixel electrode 973, the counter substrate electrode 974, a liquid crystal capacitance 971, and an auxiliary capacitance 972. The display panel is also provided with a backlight as a light source over its back. When the pixel switches 964 are turned on (activated) by scan signals from the scan lines 961, gray-scale voltage signals from the data lines 962 are applied to the corresponding pixel electrodes 973. The potential difference between each pixel electrode 973 and the counter substrate electrode 974 changes the transmittance of light emitted by the backlight and passing through the liquid crystal. The potential difference is held in the corresponding liquid crystal capacitance 971 and auxiliary capacitance 972 for a given period of time even after the corresponding pixel switch 964 is turned off (inactivated), thereby displaying an image. Meanwhile, to prevent degradation of the liquid crystal, liquid crystal display apparatuses are driven in such a manner that the polarity (positive or negative) of the common voltage of the counter substrate electrode 974 is inverted for each pixel, usually, every one frame period (inversion drive). Typical inversion drive types include dot inversion drive, where adjacent pixels show different voltage polarities, and column inversion drive, where adjacent data lines show different voltage polarities. In dot inversion drive, gray-scale voltage signals having different voltage polarities are outputted to the data lines 962 every selection period (every data period); in column inversion drive, gray-scale voltage signals having the same voltage polarity are outputted to the data lines 962 every selection period (every data period).

Referring to FIGS. 3A and 3B, a display panel 960 of an organic light-emitting diode display apparatus includes a semiconductor substrate having unit pixels each including a pixel switch 964, an organic light-emitting diode 982, and a thin-film transistor (TFT) 981 arranged in a matrix thereon. The organic light-emitting diode 982 is composed of an organic film between two thin film electrode layers. The TFT 981 controls the current supplied to the organic light-emitting diode 982. The TFTs 981 and the organic light-emitting diodes 982 are coupled in series between power supply terminals 984 and 985 that receive different power supply voltages. The unit pixel further includes an auxiliary capacitance 983 for holding the control terminal voltage of the TFT 981. A display element 963 corresponding to the unit pixel includes the TFT 981, the organic light-emitting diode 982, the power supply terminals 984 and 985, and the auxiliary capacitance 983. When the pixel switches 964 are turned on (activated) by the scan signals from the scan lines 961, gray-scale voltage signals from the data lines 962 are applied to the control terminals of the corresponding TFTs 981. The TFTs 981 supply currents corresponding to the gray-scale voltage signals to the corresponding organic light-emitting diodes 982, which then emit light with luminance corresponding to the currents, thereby displaying an image. Even after the pixel switches 964 are turned off (inactivated), the gray-scale voltage signals applied to the control terminals of the TFTs 981 are held in the auxiliary capacitances 983 for a given period of time. Thus, the light emission is maintained. While the pixel switch 964 and the TFT 981 are composed of n-type transistors in this embodiment, they may be composed of p-channel transistors. Alternatively, the organic EL element may be coupled to the power supply terminal 984. The organic light-emitting diode display apparatus does not need to be driven by inversion drive unlike the liquid crystal display apparatus; gray-scale voltage signals corresponding to the pixels are outputted every selection period (every data period). While the organic light-emitting diode display apparatus makes an image on the basis of the gray-scale voltage signals from the data lines 962 in this embodiment, it may make an image on the basis of gray-scale current signals outputted from the data driver.

As described above, in the above-mentioned display apparatuses, data corresponding to one screen is rewritten every frame period (usually, about 0.017 sec at a 60-Hz drive frequency). Specifically, pixel rows (lines) corresponding to the scan lines are sequentially selected (that is, the pixel switches are turned on), and the data lines provide gray-scale voltage signals to the display elements via the pixel switches turned on in a selection period. One selection period refers to a period of time obtained by dividing about one frame period by the number of scan lines. The data driver outputs gray-scale voltage signals corresponding to pieces of image data to the data lines every selection period. Hereafter, a data driver configured to drive active-matrix display apparatuses will be described.

The data driver includes multiple digital-analog conversion circuits (D/A converters). Each D/A converter generates reference voltages corresponding to gray-scale characteristics by dividing γ-voltages applied externally using resistors and selects a reference voltage corresponding to received digital image data from the reference voltages. The selected reference voltage is inputted to the output buffer (output amplifier) of a voltage follower. The respective numbers of D/A converters and output buffers correspond to the number of data lines of the display panel. Gray-scale voltage signals corresponding to pieces of image data are outputted to the data lines of the display panel. Generally, data drivers comprise semiconductor driver LSIs (large scale integrated circuits). One or more driver LSIs corresponding to the number of data lines of the display panel are mounted on the display panel. The driver LSIs provide gray-scale voltage signals to the data lines of the display panel.

Display apparatuses for use in televisions or display apparatuses for personal computer have been provided with larger screens with higher resolutions in recent years. The number of data lines of the display panel has been increased accordingly. As a result, the data driver (driver LSIs) has been required to have more outputs (more pins). For example, with regard to liquid crystal televisions or the like supporting full high-definition (full HD) (height 1080×width 1920×RGB), the number of data lines is 1920×3. The data drivers (driver LSIs) are coupled to these data lines. For a data driver having 720 outputs, 8 data drivers are required; for a data driver having 960 outputs, 6 data drivers are required; and for a data driver having 1440 outputs, 4 data drivers are required. As the number of data drivers to be mounted is reduced, the number of members required to mount data drivers is reduced. As a result, cost can be reduced. However, the distance between the output pads of the data drivers (driver LSIs) is smaller than that between the data lines of the display unit of the display panel. This increases the difference between the lengths (the difference between the maximum length and the minimum length) of the leader lines in the fan-out region extending from the edge of the display unit to the pads of the driver LSIs. Thus, the difference in resistance between the leader lines is increased, which may cause unevenness in display. As a countermeasure, a method is proposed for reducing the difference in resistance between the leader lines.

FIG. 4 is a diagram schematically showing the configuration of a flat display panel. A display panel 90 shown in FIG. 4 includes a display unit 91, a scan line drive circuit 92, and data drivers (driver LSIs) 100. The data drivers 100 are composed of silicon LSIs or silicon LSIs packaged with a tape-shaped thin film (called TCP (Tape Carrier Package) or COF (Chip on Film)).

While three data drivers 100 are shown for the sake of convenience in the example shown in FIG. 4, the number of data drivers 100 varies depending on the number of data lines of the display panel and the number of outputs of one data driver 100. In a display apparatus having a large display panel, the display panel 90 is driven using multiple data drivers 100. The display panel 90 is divided into the same number of regions as the number of data drivers 100, and each region is driven by the corresponding data driver 100.

The pitch of the output terminals of one data driver 100 is smaller than the distance between the data lines installed in the display unit 91. (The driver output terminals may be the output pads of TCP or COF.)

To couple the data lines of the display unit 91 to the data drivers 100, the leader lines of the data lines are installed obliquely in the shape of sectors in a fan-out region 99 extending from the edge of the display unit 91 to the data drivers 100 in such a manner that the distance between the adjacent leader lines is reduced toward the data drivers 100.

Thus, a shorter leader line (low resistance) is coupled to the chip center of the data driver 100, and a longer leader line (high resistance) is coupled to the chip end thereof. A large difference in resistance between the leader lines makes a large difference between the data line drive waveforms (rounding, etc.) of gray-scale voltage signals outputted from the data driver 100.

For this reason, even when gray-scale voltage signals having the same gray scale are outputted, the rate of voltage write to the pixel may vary depending on the difference in rounding between the signal waveforms. This may make a difference in luminance between the display regions corresponding to the respective data lines coupled to the chip center and the chip end, causing unevenness in display.

Data drivers have been required to have more outputs than conventional 720 or fewer outputs in recent years, for example, 960 outputs or 1000 or more outputs. As the number of outputs of one data driver 100 increases, the difference in resistance between the leader lines increases, easily causing unevenness in display.

Where the scan line drive circuit 92 is composed of a gate driver (LSI), the leader lines take a shape similar to that for the data drivers 100. Where the scan line drive circuit 92 is formed as a thin film transistor circuit on the display panel 90, the leader lines coupled to the outputs thereof may have an equal length.

A method for compensating for the differences in resistance between the leader lines of the data lines (or gate lines) in the fan-out region 99 is disclosed in Japanese Unexamined Patent Application Publication No. Hei 10(1998)-153791. Japanese Unexamined Patent Application Publication No. Hei 10(1998)-153791 discloses a liquid crystal display apparatus including: multiple display-side electrodes disposed at an edge of a liquid crystal display unit, multiple terminal-side electrodes disposed at the junction of TCP, parallel lines connecting the corresponding display-side electrodes and terminal-side electrodes and extending from the terminal-side electrodes in a direction identical to the direction of the disposition of the terminal-side electrodes, radial lines extending from the parallel lines radially and reaching the display-side electrodes, and line electrodes having a small width, wherein the lengths of the parallel lines become longer as the distances between the corresponding display-side electrodes and terminal-side electrodes are shorter and wherein parts of the parallel lines in the line electrodes are formed into bent lines that each have one or more bends in accordance with the length thereof and that approximately match the resistances of the line electrodes with each other. In Japanese Unexamined Patent Application Publication No. Hei 10(1998)-153791, the shorter leader line coupled to the chip center is bent in such a manner that the resistance of the shorter leader line is matched with that of the leader line coupled to the chip end.

However, bending the leader line reduces the distance between the adjacent lines. This may easily cause shorting between the adjacent lines or a break in the bend, reducing the yield of the display panel.

Japanese Unexamined Patent Application Publication No. 2004-70317 discloses a configuration where compensation resistors are disposed at the outputs of a driver LSI so as to compensate for the differences in resistance between the leader lines. FIG. 5 is a diagram obtained by referring to FIG. 5 of Japanese Unexamined Patent Application Publication No. 2004-70317. In FIG. 5, compensation resistors 109 are disposed between output buffers 101 corresponding to the outputs of a data driver 100 and driver output terminals 102. The resistances of the compensation resistors are set such that the respective sums of these resistances and the resistances of the corresponding leader lines in a fan-out region 99 are the same.

For the compensation resistors 109 of FIG. 5, the resistances of the compensation resistors adjacent to the chip ends (outputs OUT1, OUT384 of the data driver 100) and corresponding to the longest leader lines (high resistance) in the fan-out region 99 are set to 0Ω; the resistances of the compensation resistors coupled to the chip center (outputs OUT92, OUT93 of the data driver 100) and corresponding to the shortest leader lines (low resistance) in the fan-out region 99 are set to 1069Ω; and the resistances of the other compensation resistors are set such that a compensation resistor closer to the chip center has a higher resistance.

FIG. 6 is a diagram showing a typical output configuration of a data driver (driver LSI) of a display apparatus as the related art. (FIG. 6 is drawn by the inventors.) Referring to FIG. 6, a data driver 100 includes multiple driver output terminals (pads) 102_1 to 102_4, output protective resistors 104_1 to 104_4 having ends coupled to the driver output terminals (pads) 102_1 to 102_4, output buffers 101_1 to 101_4, and multiple output switches 103_1 to 103_4 coupled between the output nodes of the output buffers 101_1 to 101_4 and the other ends of the output protective resistors 104_1 to 104_4. To simplify the description, FIG. 6 shows four output buffers 101, four driver output terminals (pads) 102, four output switches 103, and four output protective resistors 104.

The output buffers (amplifiers) 101_1 to 101_4 amplify and output image signals to be outputted to data lines 96_1 to 96_4. The output switches 103_1 to 103_4 have the function of temporarily blocking gray-scale voltage signals outputted from the output buffers 101_1 to 101_4 to the corresponding data lines in accordance with a common control signal S1. For example, the output switches 103_1 to 103_4 are temporarily turned off to change the gray-scale signals so as to prevent transition noise caused by the change of the gray-scale signals from being transmitted to the data lines. For another example, to recover the electric charge of the data line capacitance by shorting adjacent data lines in order to reduce power consumption, the output switches 103_1 to 103_4 are turned off in common to block gray-scale voltage signals outputted from the output buffers 101_1 to 101_4 to the corresponding data lines. The output protective resistors 104_1 to 104_4 are disposed in order to prevent electrostatic damage, and the resistances thereof are set to similar resistances.

SUMMARY

The above-mentioned related art examples are analyzed as follows.

Where leader lines are bent as in Japanese Unexamined Patent Application Publication No. Hei 10(1998)-153791, shorting between adjacent lines, a break in a bend, or the like easily occurs, reducing the yield of the display panel.

Where compensation resistors for compensating for the differences in resistance between the leader lines are disposed inside a data driver (driver LSI) as in Japanese Unexamined Patent Application Publication No. 2004-70317, it is difficult to test uniformity in dynamic characteristics between the outputs of the data driver. This is because the outputs have different compensation resistances. For example, it is difficult to test uniformity in slew rate between the output buffers (output amplifiers) using a tester (measuring instrument) or the like.

According to an aspect of the present invention, a data driver for display panels includes: multiple driver output terminals coupled to multiple data lines of a display panel; and multiple output circuits that output output signals from the driver output terminals. Each output circuit includes: an output buffer that outputs an output signal; a first resistor having one end coupled to one of the driver output terminals; a first switch and a second resistor coupled in series between an output node of the output buffer and the other end of the first resistor; and a second switch coupled in parallel to the first switch and the second resistor between the output node of the output buffer and the other end of the first resistor.

According to the aspect of the present invention, even when the compensation resistors for compensating for the differences in resistance between the leader lines are disposed in the data driver, it is possible to perform a test for uniformity in dynamic characteristics between the output circuits.

DESCRIPTION OF THE PREFERRED EMBODIMENTS

Figure 1:
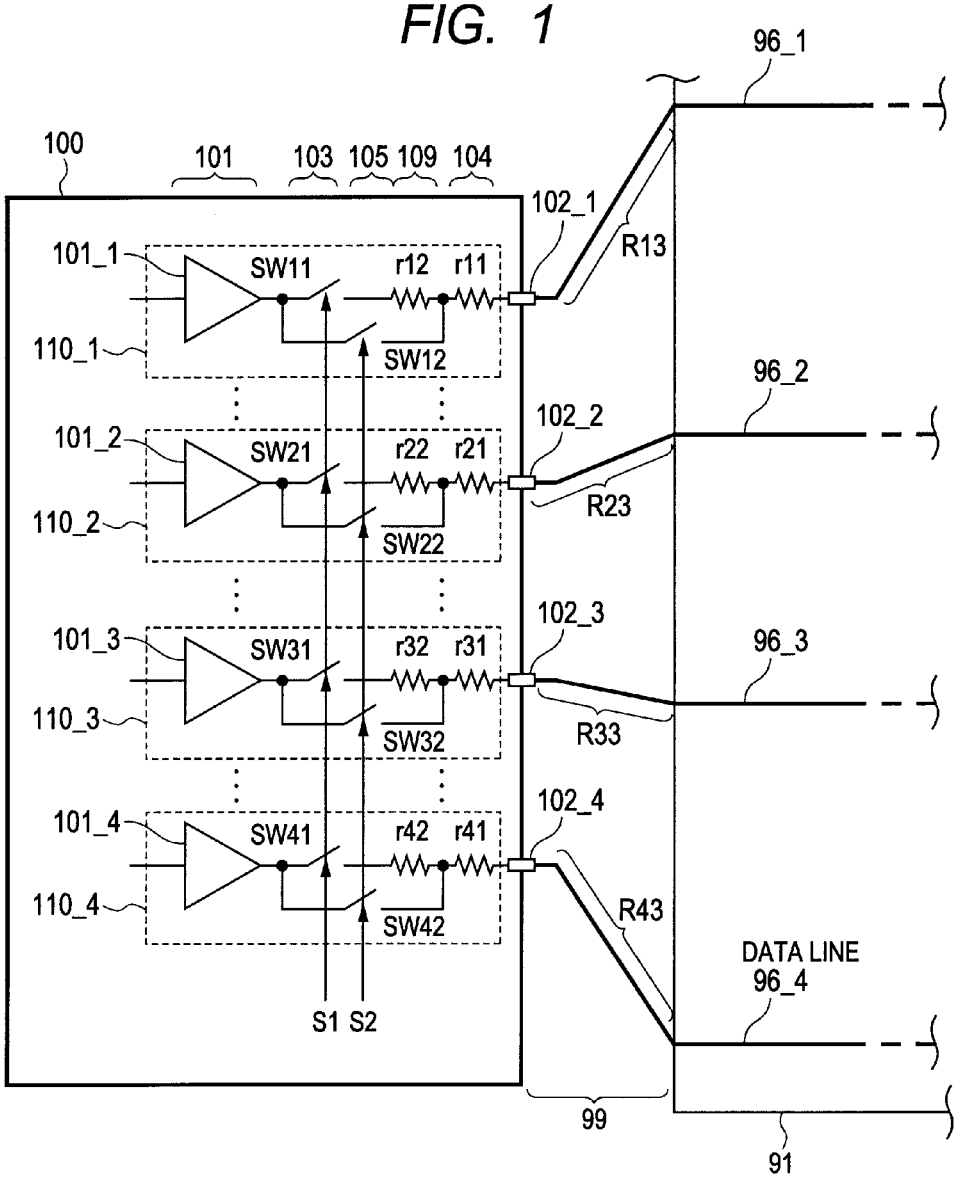
FIG. 1 is a diagram showing a level shift circuit according to a first embodiment of the present invention.

Now, preferred embodiments of the present invention will be described. In some preferred embodiments, multiple (n number of) output circuits that output gray-scale signals from driver output terminals are disposed. For example, a first output circuit includes an output buffer (e.g., 101_1), a first resistor (e.g., r11) having one end coupled to one driver output terminal (e.g., 102_1), a first switch (e.g., SW11) and a second resistor (e.g., r12) coupled in series between the output node of the output buffer (e.g., 101_1) and the other terminal of the first resistor (e.g., r11), and a second switch (e.g., SW12) coupled in parallel to the first switch and the second resistor between the output node of the output buffer and the other end of the first resistor. The second to n-th output circuits have a similar configuration. The second resistors (r12, r22, r23, r24) of the output circuits are compensation resistors (109) for compensating for the differences in resistance between the leader lines of the data lines in a data driver. The second switches (SW12, SW22, SW23, and SW24) of the output circuits are test switches (105).

The resistances of the first resistors r11, r21, r31, r41 are set to similar resistances in the respective output circuits. The resistances of the second resistors r12, r22, r32, r42 in the respective output circuits are set to resistances corresponding to line resistances (R13, R23, R33, R43) of data lines in a fan-out region 99 of the display panel. The difference between the maximum and minimum of the respective sums (r12+R13, R22+R23, R32+R33, R42+R43) of the resistances of the second resistors of the output circuits and the corresponding line resistances is set so as to be smaller than the difference between the maximum and minimum of the line resistances (R13, R23, R33, R43).

The first switches (SW11, SW21, SW31, SW41) and the second switches SW12, SW22, SW32, SW42 of the output circuits are on-off controlled by a common first control signal (S1) and a common second control signal (S2), respectively. A predetermined test is performed with the first switches turned off by the first control signal (S1) and with the second switches turned on by the second control signal (S2).

The first and second switches of the output circuits are on-off controlled by the common first and second control signals, respectively. For example, to output output signals to the data lines of the display panel, the first switches (SW11, SW21, SW31, SW41) are turned on by the first control signal S1, and the second switches (SW12, SW22, SW32, SW42) are turned off by the second control signal S2. When the second switches (SW12, SW22, SW32, and SW42) are turned on by the second control signal S2, the first switches (SW11, SW21, SW31, SW41) are turned off by the first control signal S1. Although the first switches (SW11, SW21, SW31, and SW41) are usually left on by the first control signal S1, they may temporarily be turned off for purposes such as to change the gray-scale signals and to short adjacent data lines to recover the electric charge of the data line capacitance. That is, both the first switches (SW11, SW21, SW31, and SW41) and the second switches (SW12, SW22, SW32, and SW42) may be turned off. The first and second switches are composed of transistor switches.

According to the present invention, by turning off the first switches and turning on the second switches even in the configuration where the compensation resistors r12, r22, r32, r42 for compensating for the differences in resistance between the leader lines of the data lines are disposed in the data driver, it is possible to perform a test for uniformity in dynamic characteristics between the output circuits. The present invention is suitably applicable to, e.g., silicon LSI data drivers, but not limited thereto. Hereafter, the present invention will be described using illustrative embodiments.

First Embodiment

Figure 4:
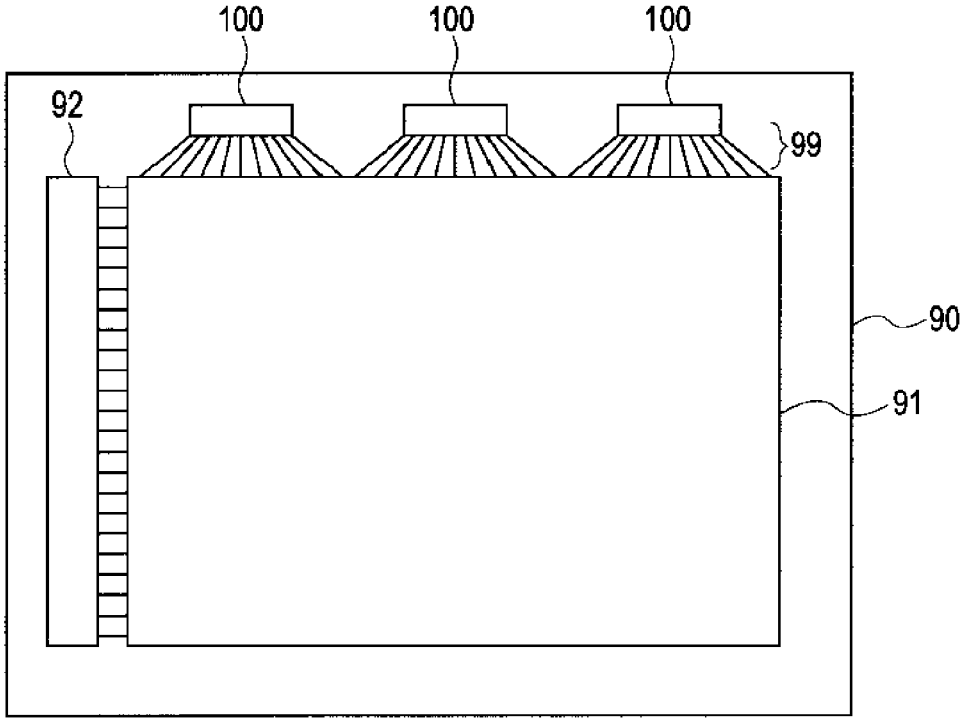
PRIOR ART FIG. 4
FIG. 4 is a diagram schematically showing the configuration of a flat display panel.
Figure 5:
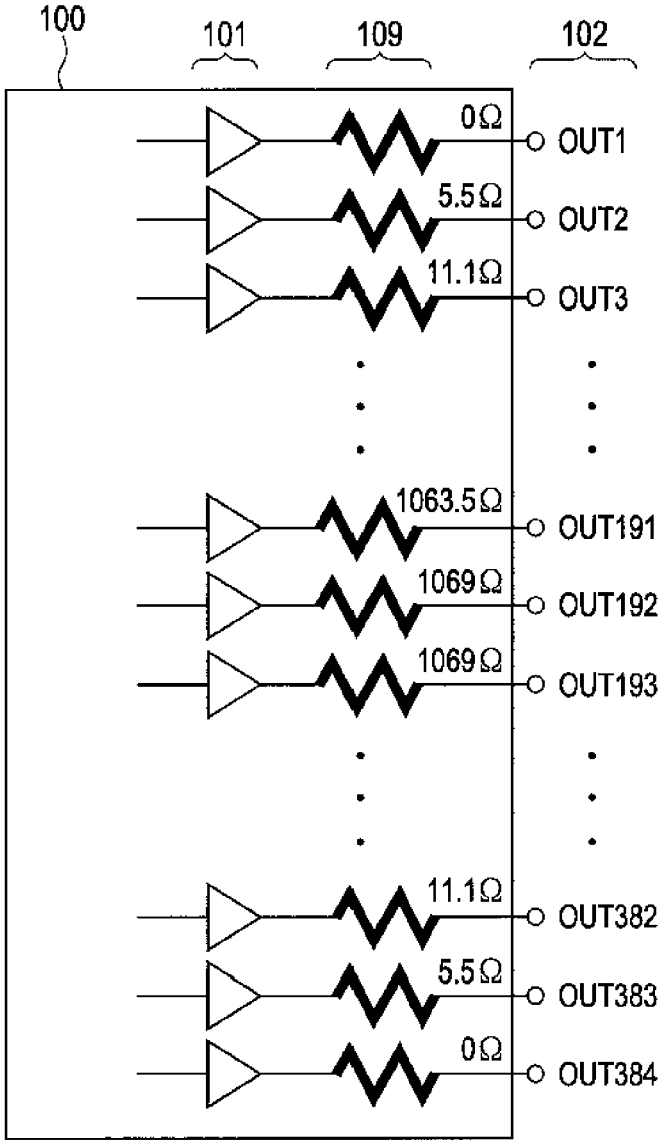
PRIOR ART FIG. 5
FIG. 5 is a diagram showing the output configuration of a data driver according to Japanese Unexamined Patent Application Publication No. Patent Application Publication No. 2004-70317.
Figure 6:
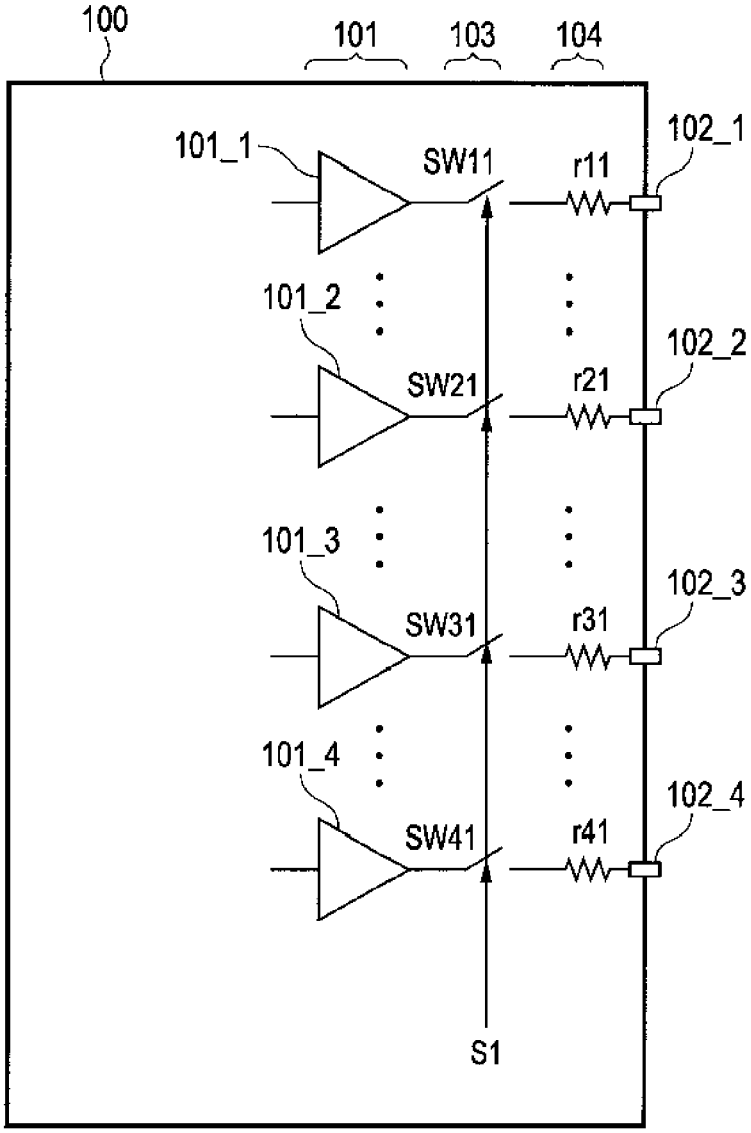
PRIOR ART FIG. 6
FIG. 6 is a diagram showing the output configuration of a data driver according to the related art.

FIG. 1 is a diagram showing a first embodiment of the present invention. In FIG. 1, identical or similar elements to those of FIGS. 4 to 6 are given same reference signs. In FIG. 1, a data driver 100 includes multiple output circuits 110_1 to 110_4 that output gray-scale signals to data lines 96_1 to 96_4 of a display unit 91 from driver output terminals 102_1 to 102_4. The output circuits 110_1 to 110_4 include output buffers 101_1 to 101_4, driver output terminals 102_1 to 102_4, output switches SW11, SW21, SW31, SW41, output protective resistors r11, r21, r31, r41, test switches SW12, SW22, SW32, SW42, and compensation resistors r12, r22, r32, r42, respectively. In FIG. 1, 101 represents the output buffers 101_1, 101_2, 101_3, 101_4; 102 the driver output terminals 102_1, 102_2, 102_3, 102_4; 103 the output switches (first switches) SW11, SW21, SW31, SW41; 104 the output protective resistors r11, r21, r31, r41; 105 the test switches (second switches) SW12, SW22, SW32, SW42; and 109 the compensation resistors r12, r22, r32, r42.

While the multiple output circuits are disposed so as to correspond to the multiple data lines, FIG. 1 shows the four output circuits representatively to simplify the description. Reference voltages selected by digital/analog (D/A) converters (not shown) corresponding to the output circuits are inputted to the input terminals of the output circuits on the basis of digital image data received by the data driver. As described in FIG. 4, the pitch of the driver output terminals 102 (the distance between the output terminals) is smaller than the distance between the data lines installed in the display unit 91. The leader lines of the data lines are installed diagonally in the shape of a sector in the fan-out region 99 extending from the edge of the display unit 91 to the data driver 100 in such a manner that the distance between the adjacent leader lines is reduced toward the data driver 100. The data driver 100 is mounted on the display panel in the form of a silicon LSI or by TCP or COF, where a silicon LSI is packaged with a tape-shaped thin film. In FIG. 1, the data driver 100 is directly mounted on the display panel in the form of a silicon LSI (by, e.g., COG (Chip on Glass)). Where the data driver 100 is mounted on the display panel by TCP or COF, the driver output terminals 102 of FIG. 1 coupled to the leader lines of the data line of the display panel are replaced with TCP or COF output pads.

An output circuit (e.g., 110_1) of the data driver 100 includes an output buffer (101_1) that amplifies and outputs gray-scale signals, an output protective resistor (r11) having one end coupled to the driver output terminal (102_1), an output switch (SW11) and a compensation resistor (r12) coupled in series between the output node of the output buffer (101_1) and the other end of the output protective resistor (r11), and a test switch (SW12) coupled in parallel to a series circuit of the output switch (SW11) and the compensation resistor (r12) between the output node of the output buffer (101_1) and the other node of the output protective resistor (r11). In FIG. 1, the output switch (SW11) is coupled to the output node of the output buffer (101_1), and the compensation resistor (r12) is coupled to the output protective resistor (r11). The other output circuits 110_2, 110_3, and 110_4 also have a similar configuration to that of 110_1.

The output switches 103 and the test switches 105 are respectively composed of elements having the same structure (same size) between the output circuits. The resistances of the output protective resistors 104 (r11, r21, r31, r41) are set to the same resistance (r11=r21=r31=r41).

The resistances of the compensation resistors 109 (r12, r22, r32, r42) are set to resistances corresponding to the resistances (R13, R23, R33, R43) of the leader lines of the corresponding data lines in the fan-out region 99 of the display panel. Preferably, for the compensation resistors 109, the resistance of the compensation resistor corresponding to the leader line being adjacent to the chip end and longest (high resistance) in the fan-out region 99 (the leader line having the resistance R13 or resistance R43) is set to 0Ω; the resistance of the compensation resistor corresponding to the leader line being adjacent to the chip center and shortest (low resistance) in the fan-out region 99 (the leader line in the midpoint of those having the resistances R23 and R33, respectively) is set to the highest; and the resistances of the other compensation resistors are set such that a compensation resistor closer to the chip center has a higher resistance.

The difference between the maximum and minimum of the respective sums of the resistances of the compensation resistors of the output circuits and the resistances of the corresponding leader lines is set so as to be sufficiently smaller than the difference between the maximum and minimum of the resistances of the leader lines.

Preferably, the difference between the maximum and minimum of the respective sums of the resistances of the compensation resistors of the output circuits and the resistances of the corresponding leader lines is preferably very small (not more than a predetermined value).

More preferably, (r12+R13)≈(r22+R23)≈(r32+R33)≈(r42+R43) such that the respective sums of the resistances of the compensation resistors of the output circuits and the resistances of the corresponding leader lines are similar to each other.

The output switches 103 and the test switches 105 may be composed of transistor switches. The transistor switches are preferably composed of CMOS switches (switches where PMOS and NMOS transistors are coupled in parallel and complementary control signals are inputted to the respective gate terminals). The test switches 105 may be of any type so long as a test for uniformity between the output circuits can be performed and therefore can be composed of transistor switches of the same, relatively small size.

To perform a uniformity test, the output switches 103 (SW11, SW21, SW31, SW41) are turned off while the test switches 105 (SW12, SW22, SW32, SW42) are turned on. Thus, even a high on-resistance of the test switches 105 (SW12, SW22, SW32, SW42) would not interfere with the test.

As a result, the test switches 105 (SW12, SW22, SW32, SW42) hardly increase the area of the data driver 100.

Similarly, if the compensation resistors 109 (r12, r22, r32, r42) are made of a material having a relatively high resistance, these resistors would hardly increase the area of the data driver 100.

In the data driver 100, the output switches 103 and the test switches 105 of the output circuits are on-off controlled by a common control signal S1 and a common control signal S2, respectively.

While the data driver 100 is mounted on the display panel in FIG. 1, a characteristic test on the data driver 100 is performed before the display panel is mounted. The characteristic test is performed on the data driver 100 which is in the form of a wafer, TCP, COF, or the like. Characteristics of signals outputted from the driver output terminals or pads are tested using a tester or the like.

Examples of a test for uniformity in dynamic characteristics between the output circuits include a test on the uniformity between the slew rates of the output buffers (output amplifiers) 101 of the output circuits conducted using a tester or the like. In such a characteristic test, the output switches 103 are turned off by the control signal S1; and the test switches 105 are turned on by the control signal S2. Thus, the output protective resistors 104 are activated; and the compensation resistors 109 are inactivated.

Subsequently, gray-scale signals outputted from the output buffers 101_1 to 101_4 pass through the test switches 105 and the output protective resistors 104 without passing through the compensation resistors 109 having resistances which are different between the output circuits. These signals are then outputted from the driver output terminals 102 and subjected to a uniformity test. Since the test switches 105 and the output protective resistors 104 are composed of elements having the same structure or having the same resistance between the output circuits, a test for uniformity can easily be performed. A data driver which has been found to have poor uniformity by the test is excluded as a nonconforming product.

The compensation resistors 109 can be tested for manufacturing variations and the like with the output switches 103 turned on by the control signal S1 and with the test switches 105 turned off by the control signal S2. Conforming products, that is, data drivers 100 that have passed tests such as a uniformity test are mounted on display panels.

The data driver 100 outputs output signals to the data lines (96_1, 96_2, 96_3, 96_4) of the display unit 91 with the test switches 105 turned off by the control signal S2. The gray-scale signals outputted from the output buffers 101 are outputted from the driver output terminals 102 to the data lines via the output switches 103, the compensation resistors 109, and the output protective resistors 104. Since the difference between the maximum and minimum of the respective sums of the resistance of the compensation resistor 109 of the output circuits and the resistance of the corresponding leader line in the fan-out region 99 is set so as to be sufficiently small, unevenness in display can be prevented.

In FIG. 1, to perform a predetermined characteristic test, gray-scale signals outputted from the output buffers 101 are outputted from the driver output terminals 102 without passing through the compensation resistors 109. This makes it possible to easily perform a test for uniformity in dynamic characteristics between the output buffers 101.

The output protective resistors 104 (r11, r12, r13, r14) are not limited to the form of resistors and may be formed as resistant regions where an output protective resistor is combined with the drain or source of an output switch (transistor switch).

Unlike this embodiment, the related art (FIG. 5) outputs gray-scale signals outputted by the output buffers of the data driver 100 from the driver output terminals via the compensation resistors having resistances different between the output circuits. This makes it difficult to perform a test for uniformity in dynamic characteristics between the output circuits.

This embodiment, on the other hand, disposes the test switches in parallel with the output switches and compensation resistors between the output nodes of the output buffers and the output protective resistors in the data driver 100. This makes it possible to easily perform a test for uniformity in dynamic characteristics between the output circuits.

In this embodiment, the output switches and the test switches are coupled to the driver output terminals via the output protection resistances.

Accordingly, the compensation resistors coupled in series to the output switches are also disposed closer to the inside of the data driver than the output protective resistors.

Second Embodiment

Figure 2:
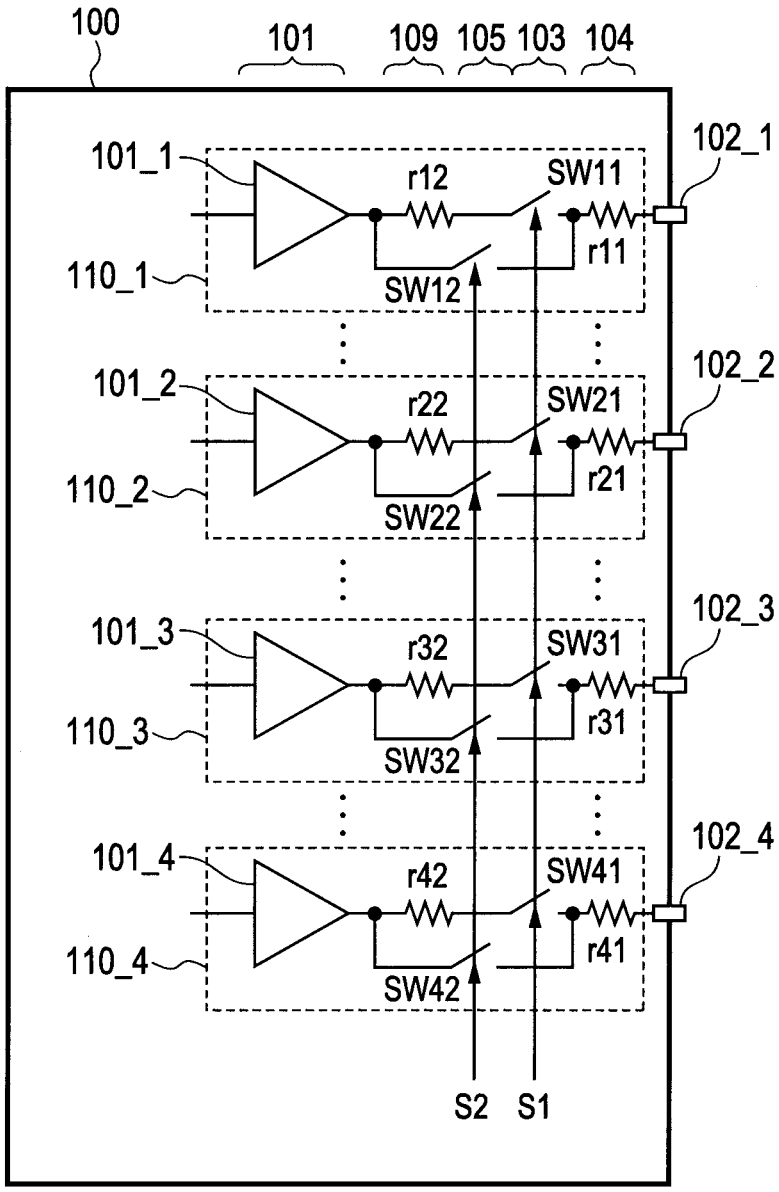
FIG. 2 is a diagram showing a level shift circuit according to a second embodiment of the present invention.
Figure 3A:
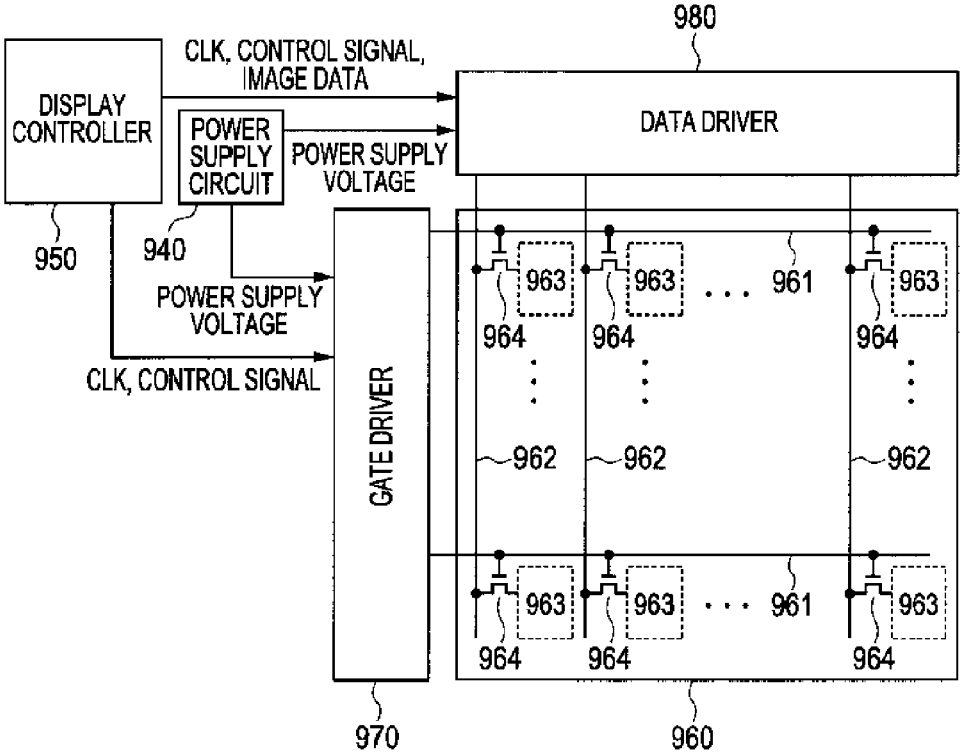
PRIOR ART FIG. 3A
FIGS. 3A to 3C are diagrams schematically showing the configuration of a display apparatus.
Figure 3B:
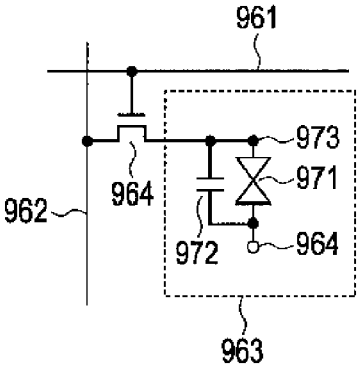
PRIOR ART FIG. 3B
Figure 3C:
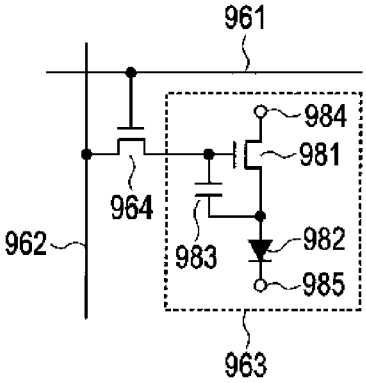
PRIOR ART FIG. 3C

FIG. 2 is a diagram showing the configuration of a second embodiment of the present invention. This is a modification to the first embodiment of FIG. 1. In FIG. 2, the data driver 100 includes multiple output circuits that output gray-scale signals from the drive output terminals to the data lines of the display unit, as in FIG. 1. FIG. 2 shows only the configuration of the data driver 100 and omits the display unit 91 and the leader lines in the fan-out region 99.

The difference between the data driver 100 of FIG. 2 and that of FIG. 1 is that the positions of the output switches 103 (SW11, SW21, SW31, SW41) and the compensation resistors 109 (r12, r22, r32, r42) are reversed. That is, the output switches 103 are coupled to the output protective resistors 104, and the compensation resistors 109 are coupled to the output buffers 101. The functions and advantages of the second embodiment are the same as those of the first embodiment and therefore will not be described.

The disclosures of the Japanese Unexamined Patent Application Publication Nos. 10(1998)-153791 and 2004-70317 are incorporated herein by reference. The embodiments can be changed or adjusted without departing from the scope of the entire disclosure of the present invention (including the claims) and on the basis of the fundamental technical concept of the invention. Further, the various disclosed elements can be combined or selected without departing from the scope of the claims of the present invention. That is, the present invention will of course include various changes and modifications that those skilled in the art can make on the basis of the entire disclosure of the invention, including the claims, and the technical concept thereof.

What is claimed is:

1. A data driver for display panels, comprising:

a plurality of driver output terminals configured to be coupled to a plurality of data lines of a display panel; and a plurality of output circuits that output output signals from the driver output terminals, each output circuit comprising:

an output buffer;

a first resistor having one end coupled to one of the driver output terminals;

a first switch and a second resistor coupled in series between an output node of the output buffer and the other end of the first resistor; and a second switch coupled in parallel to the first switch and the second resistor between the output node of the output buffer and the other end of the first resistor, wherein resistances of the first resistors of the output circuits are set to same or similar resistances, wherein resistances of the second resistors of the output circuits are set to resistances corresponding to resistances of a plurality of leader lines coupled between the driver output terminals and the data lines of the display panel, and wherein a difference between the maximum and minimum of respective sums of the resistances of the second resistors of the output circuits and the resistances of the corresponding leader lines is set so as to be smaller than a difference between the maximum and minimum of the resistances of the leader lines.

2. The data driver for display panels according to claim 1, wherein the first switches of the output circuits are on-off controlled in common, wherein the second switches of the output circuits are on-off controlled in common, wherein, when the first switches of the output circuits are turned on, the second switches of the output circuits are turned off, and wherein, when the second switches of the output circuits are turned on, the first switches of the output circuits are turned off.

3. The data driver for display panels according to claim 1, wherein a common first control signal is provided to the output circuits so as to on-off control the first switches of the output circuits, and wherein a common second control signal is provided to the output circuits so as to on-off control the second switches of the output circuits.

4. The data driver for display panels according to claim 3, wherein a test is performed in a state where, in the output circuits, the first switches are turned off by the first control signal, the second switches are turned on by the second control signal, and the output nodes of the output buffers are coupled to the other ends of the first resistors not via the second resistors.

5. The data driver for display panels according to claim 3, wherein the output circuits output output signals to the corresponding data lines of the display panel as a normal operation with the first switches turned on by the first control signal and with the second switches turned off by the second control signal.

6. The data driver for display panels according to claim 1, wherein the first and second switches include transistor switches.

7. A display apparatus comprising:

the data driver for display panels according to claim 1;

the data lines coupled to the drive output terminals of the data driver;

a plurality of scan lines; and a display panel including pixels, the pixels being disposed at intersections of the data lines and the scan lines and configured to display an image on the basis of signals from the data lines when the scan lines are selected.

8. The data driver for display panels according to claim 1, wherein the first switch receives a first control signal that is different from a second control signal received by the second switch.

9. A data driver for display panels, comprising:

a plurality of driver output terminals configured to be coupled to a plurality of data lines of a display panel; and a plurality of output circuits that output output signals from the driver output terminals, each output circuit comprising:

an output buffer;

a first resistor having one end coupled to one of the driver output terminals;

a first switch and a second resistor coupled in series between an output node of the output buffer and the other end of the first resistor; and a second switch coupled in parallel to the first switch and the second resistor between the output node of the output buffer and the other end of the first resistor, wherein resistances of the first resistors of the output circuits are set to same or similar resistances, wherein resistances of the second resistors of the output circuits are set to resistances corresponding to resistances of a plurality of leader lines coupled between the driver output terminals and the data lines of the display panel, and wherein a difference between the maximum and minimum of respective sums of the resistances of the second resistors of the output circuits and the resistances of the corresponding leader lines is set so as to be not more than a predetermined value.

* * * * *